US006104342A

United States Patent [19]

Noel et al.

[11] Patent Number: 6,104,342

[45] Date of Patent: Aug. 15, 2000

[54] SCANNED ANTENNA ARRAY COMPRISING A FERRITE SCANNING LINE SOURCE

[75] Inventors: Philip L. Noel, Richardson; Arno L. Lindorfer, Allen, both of Tex.

[73] Assignee: Raytheon Company, Lexington, Mass.

[21] Appl. No.: 08/388,777

[22] Filed: Feb. 15, 1995

[51] Int. Cl.[7] ..... H01Q 3/22; H01P 1/195; H01P 5/12

[52] U.S. Cl. ..... 342/372; 333/24.1; 333/137; 333/158

[58] Field of Search ..... 333/24.1, 125, 333/137, 158; 342/372

[56] References Cited

U.S. PATENT DOCUMENTS

| | | | |
|---|---|---|---|
| 3,212,031 | 10/1965 | Reggia et al. | 333/158 |
| 3,277,401 | 10/1966 | Stern | 333/24.1 |
| 4,884,045 | 11/1989 | Alverson et al. | 333/24.1 X |

OTHER PUBLICATIONS

"A New Technique in Ferrite Phase Shifting for Beam Scanning of Microwave Antennas" F. Reggia & E. G. Spencer, Proceedings by the IRE, Nov. 1957, pp. 1510–1517.

"Inexpensive Phased Array Opens Up New Radar Applications", Richard T. Davis, Microwaves, Aug., 1975, 2 pages.

"Array Excitation Structure" Ferrite Steered Subarray Final Report, Jan., 1983, pp. 29–41.

*Primary Examiner*—Paul Gensler

*Attorney, Agent, or Firm*—Rene E. Grossman; Richard L. Donaldson

[57] ABSTRACT

A scanned antenna array and the ferrite scanning source controlling the array which includes a ferrite scanning line source (21) comprising a ferrite element (23) having an RF input (25), a current source (31) extending through the ferrite element and a plurality of RF outputs (27) spaced apart along the ferrite element and an antenna element (33) coupled to each of the RF outputs. Each of the RF outputs is equally spaced apart from adjacent RF outputs. The ferrite element has an input end portion and an output end portion and an axis therebetween, the RF outputs being disposed along the axis. The ferrite element comprises a pair of ferrite toroids (43, 45) spaced apart by a layer of dielectric material (47), the RF outputs (49) being disposed in the dielectric material.

11 Claims, 3 Drawing Sheets

SCANNED ANTENNA ARRAY COMPRISING A FERRITE SCANNING LINE SOURCE

BACKGROUND OF THE INVENTION

1. Field of the Invention

This invention relates to phase shifters and, more specifically, to a ferrite scanning line source, particularly for use in conjunction with a phased array.

2. Brief Description of the Prior Art

Phase shifters in the prior art are considered as a single phase shifting element, generally a loaded ferrite waveguide, configured with one RF input port and one RF output port for RF energy. Insertion characteristics of the ferrite material are controlled with a driver circuit providing a current passing through the ferrite material, causing a precisely controlled phase shift of the output signal. The output signal is utilized to drive, as required, each element in, for example, a phased array. A separate phase shifter as described is required for each element of the phased array.

In accordance with the prior art, the elements of a phased array have been controlled by a transmit/receive (T/R) module or other costly device connected to each element of the phased array. The T/R modules provide the transmit signal to be radiated and a receiver function for the returned signal. One T/R module driving each antenna element provides the maximum antenna steering control. However, T/R modules are costly. It follows that a system which uses fewer components and is less expensive is highly desirable.

SUMMARY OF THE INVENTION

In accordance with the present invention, there is provided a ferrite scanning line source which has multiple outputs for each input, the outputs being precisely controlled to feed multiple elements in a phased array. The advantage provided by the ferrite scanning line source is that only one integrated phase shifter and driver circuit is required to control plural elements of the phased array, hence, only one T/R module is required for a row or column of elements.

Multiple outputs are achieved by coupling to the phase shifter at fixed spaces along its length such that a single command to the driver generates a fixed phase shift for each spacing increment. Phase shift accumulates along the phase shifter length (field of coupled outputs) such that the nth output has n times the incremental phase shift of the first output, assuming equal spacing of the outputs, resulting in a phase slope across the outputs. The outputs need not be equally spaced apart, the equal spacing being the preferred embodiment. When those outputs feed an individual linear array of elements, array steering is accomplished in the plane of those elements. Beamshape requirements in the steered plane are accommodated by designing the coupling ratios at each increment to amplitude weight the coupled outputs. Phase alignment of the outputs to the radiating elements is accomplished, if required, with fixed line-length adjustments in the output lines that connect to the elements. Phase and amplitude controls are thus isolated from each other, providing a beamshape that is independent of scan and hence not limited by scan.

In accordance with the invention, a single ferrite scanning line source provides the necessary control for all of the elements of the phased array row or column with one phase shifter. Beamshaping is accomplished by amplitude weighting which is built in to the line source. Steering is accomplished with the phase shifter. Where prime power, cooling capacity and weight are at a premium and the cost of providing these features a burden, the subject device has a distinct advantage over the prior art. This is the case for many airborne and satellite applications.

DESCRIPTION OF THE PREFERRED EMBODIMENT

Figure 1:
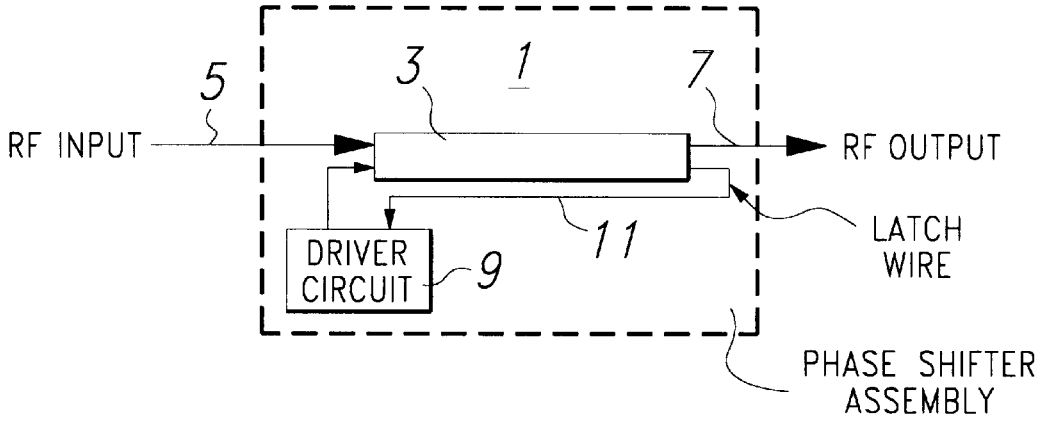
Fig. 1 PRIOR ART
FIG. 1 is a schematic diagram of a prior art ferrite phase shifter.

Referring first to FIG. 1, there is shown an example of a typical prior art ferrite phase shifter 1. The phase shifter 1 includes a single phase shifting element 3, such as, for example, a loaded ferrite waveguide, having one RF input port 5 and one RF output port 7. The amount of phase shift is determined by the amount of bias of the ferrite material within the waveguide. The insertion characteristics or polarization of the ferrite material within the phase shifting element are controlled by a driver circuit 9 coupled to a latch wire 11 extending through the ferrite material element, the current provided through the latch wire, which can be continuous or discontinuous, determining the bias provided to the ferrite material which sets the magnetic flux density in the ferrite and the phase shift provided by the phase shifter.

Figure 2:
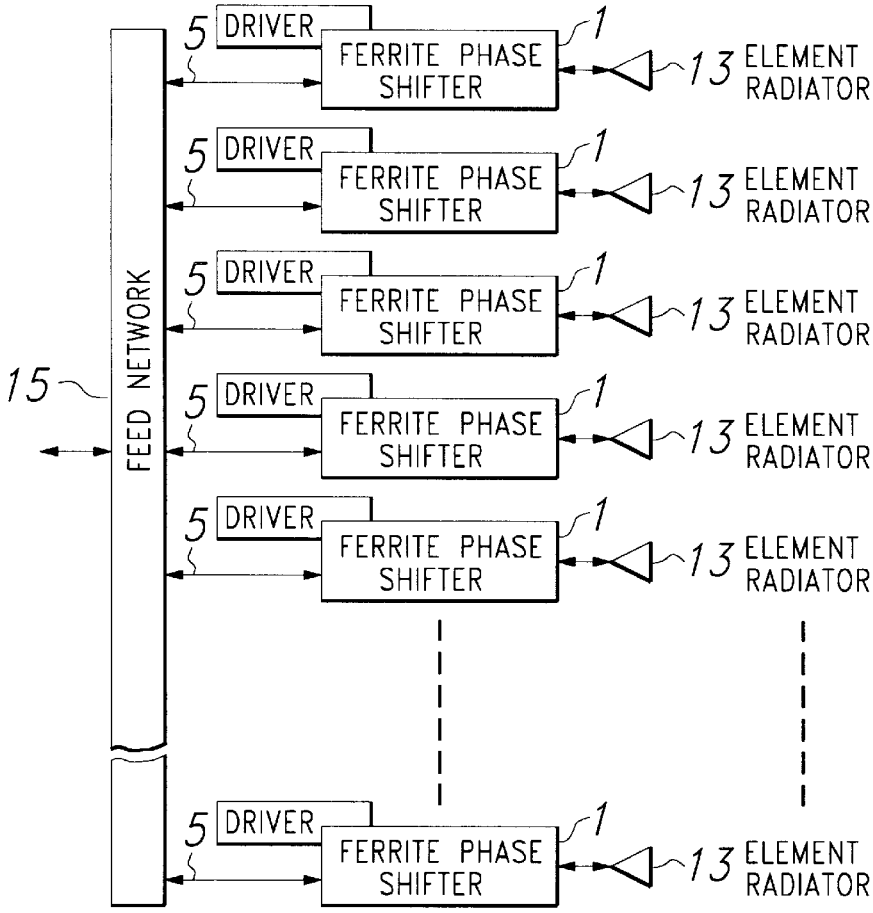
Fig. 2 PRIOR ART
FIG. 2 is a schematic diagram of a prior art application of the ferrite phase shifter of FIG. 1 to a phased array.

FIG. 2 shows the phase shifter 1 of FIG. 1 utilized as a typical prior art controller of the element radiators 13 of a phased array. Information is fed to and received from the RF inputs 5 by a standard feed network 15.

Figure 3:
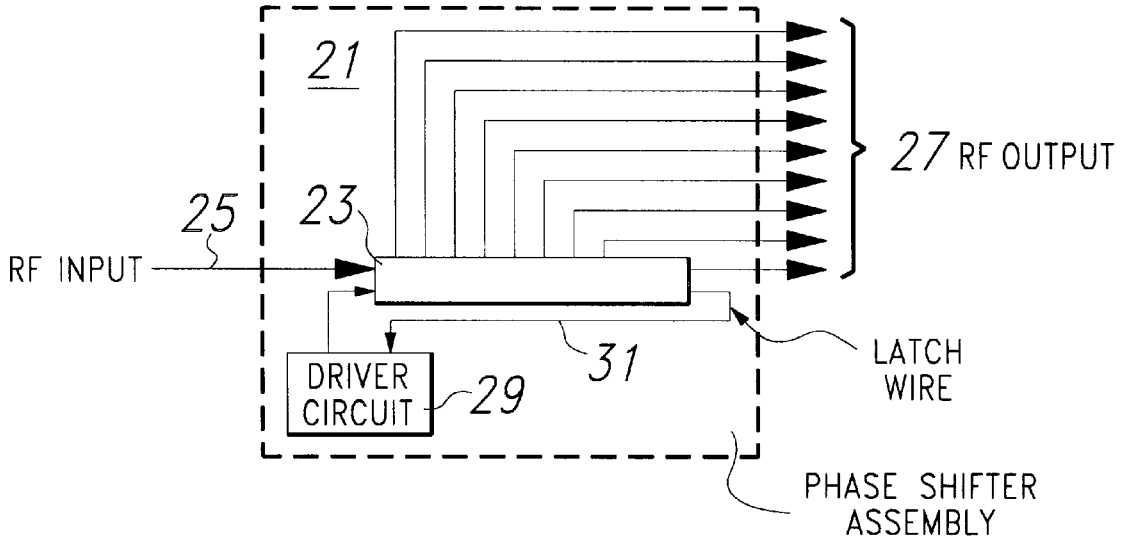
FIG. 3 is a schematic diagram of a ferrite scanning line source in accordance with the present invention.

Referring now to FIG. 3, there is shown a ferrite scanning line source 21 in accordance with the present invention. The scanning line source 21 includes a single phase shifting element 23, such as, for example, a loaded ferrite waveguide, having one RF input port 25 and plural RF output ports 27. Each of the output ports 27 is coupled to the ferrite waveguide 23 at different locations along the length of the waveguide, the spacing between output ports preferably being equal. A driver 29 is coupled to a latch wire 31 which extends through the ferrite material in the waveguide 23 as in the prior art. The insertion characteristics or polarization of the ferrite material within the phase shifting element 21 are controlled by the driver circuit 29 coupled to a latch wire 31 extending through the ferrite material element, the current provided through the latch wire, which can be continuous or discontinuous, determining the bias provided to the ferrite material and setting the magnetic flux density in the ferrite and the phase shift provided by the phase shifter.

A single command to the driver 29 generates a fixed phase shift for each spacing increment of the output ports 27. Phase shift accumulates along the phase shifter length (field of coupled outputs) such that the nth output has n times the incremental phase shift of the first output, assuming equal spacing between adjacent output ports 27, resulting in a phase slope across the outputs.

Figure 4:
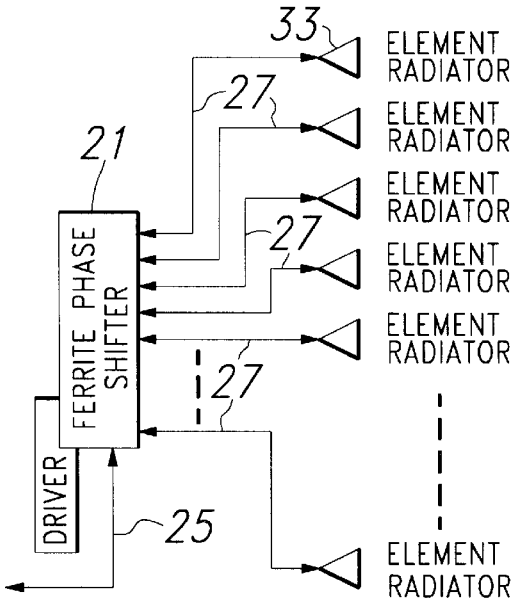
FIG. 4 is a schematic diagram of the application of the ferrite scanning line source of FIG. 3 to a phased array.

With reference to FIG. 4, when the outputs 27 of the ferrite scanning line source 21 feed an individual linear array of elements 33, array steering is accomplished in the plane of those elements. Beamshape requirements in the steered plane are accommodated by designing the coupling ratios at each increment to amplitude weight the coupled outputs. Phase alignment of the outputs 27 to the radiating elements 33 is accomplished, if required, with fixed line-length adjustments in the output lines 27 that connect to the elements. Phase and amplitude controls are thus isolated from each other, providing a beamshape that is independent of scan and hence not limited by scan.

Figure 5:
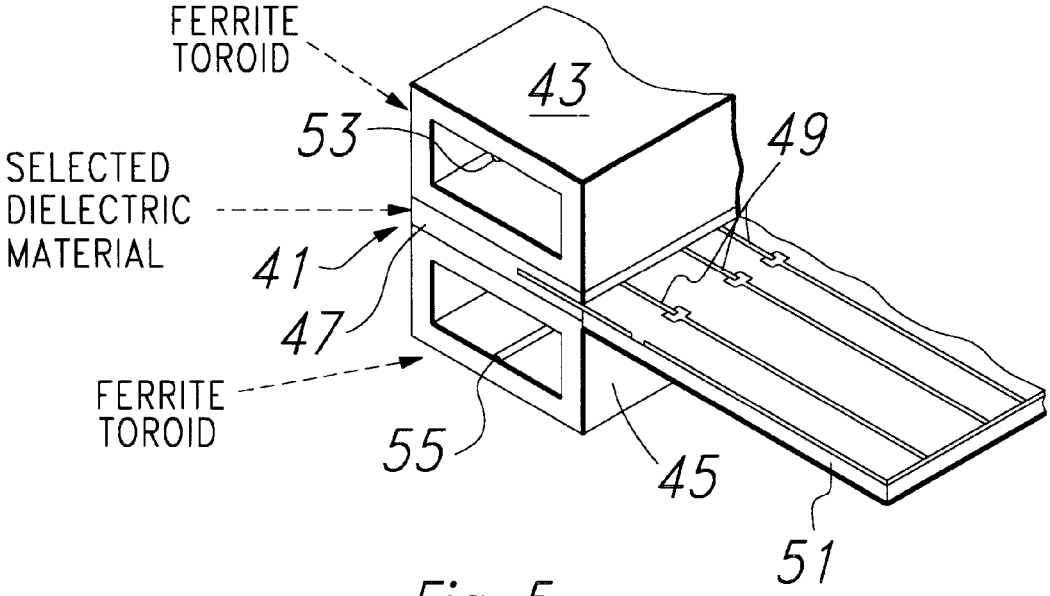
FIG. 5 is a diagram of a preferred embodiment of a ferrite scanning line source in accordance with the present invention.

Referring now to FIG. 5, there is shown a preferred embodiment of a ferrite scanning line source 41 in accordance with the present invention. The source 41 includes a standard pair of ferrite toroids 43 and 45 using standard ferrite materials which are spaced apart from each other by a selected dielectric material spacer 47 and are in the form of a standard dual toroid ferrite phase shifter. The choice of dielectric material is determined by the choice of ferrite material, the choice of ferrite material deriving from the frequency of operation, RF power level and other considerations, as is well known. The main purpose of the dielectric material spacer 47 is to separate the two toroids with material that compensates for changes in electrical characteristics with temperature without disrupting the microwave energy traveling through the device. A latch wire 53, 55 extends through each of the toroids 43, 45 in standard manner. A single wire can be used for both toroids, however this arrangement slows switching time and is generally unsatisfactory. The field strength is maximized in the region of the dielectric spacer 47 between the two toroids 43 and 45 and coupled outputs are achieved by insertion of spaced apart RF probes 49 into the dielectric spacer. The probes 49 rest on a ceramic microstrip 51. Coupling ratios are achieved by the size and insertion depth within the spacer 47 of the probes 49. An output circuit in the form of the ceramic microstrip 51 is permanently bonded to the dual toroid assembly with provision to limit disruption of the metal plating (not shown) that surrounds the dual toroid assembly. The assembly can be mounted in a phased array with existing technology and connections to the weighted RF outputs is also standard.

It should be noted that, while only one latch wire is shown or implied in FIGS. 1 to 4 for simplicity, all are intended to be dual toroid phase shifters with two latch wires, one for each toroid as shown in FIG. 5. Alternatively, one latch wire can be used twice for slow switching applications as stated above and as is well known.

Though the invention has been described with reference to a specific preferred embodiment thereof, many variations and modifications thereof will immediately become apparent to those skilled in the art. It is therefore the intention that the appended claims be interpreted as broadly as possible in view of the prior art to include all such variations and modifications.

We claim:

1. A ferrite scanning line source which comprises:

(a) a ferrite element having an RF input, said ferrite element forming an RF transmission line and comprising a pair of metalized ferrite toroids spaced apart by a layer of dielectric material;

(b) a current source including a current transmission line extending through each said toroid; and (c) a plurality of RF outputs disposed in said dielectric material spaced apart along said ferrite element.

2. The source of claim 1 wherein each of said RF outputs is equally spaced apart from adjacent RF outputs.

3. The source of claim 2 wherein each of said toroids has an input end portion and an output end portion and an axis therebetween, said RF outputs being disposed along said axis.

4. The source of claim 1 wherein each of said toroids has an input end portion and an output end portion and an axis therebetween, said RF outputs being disposed along said axis.

5. A scanned antenna array comprising:

(a) a ferrite scanning line source which comprises:

(i) a ferrite element having an RF input, said ferrite element forming an RF transmission line and comprising a pair of metalized ferrite toroids spaced apart by a layer of dielectric material;

(ii) a current source including a current transmission line extending through each said toroid; and (iii) a plurality of RF outputs disposed in said dielectric material spaced apart along said ferrite element; and (b) an antenna element coupled to each of said RF outputs.

6. The source of claim 5 wherein each of said RF outputs is equally spaced apart from adjacent RF outputs.

7. The source of claim 6 wherein each said toroid has an input end portion and an output end portion and an axis therebetween, said RF outputs being disposed along said axis.

8. The source of claim 5 wherein each said toroid has an input end portion and an output end portion and an axis therebetween, said RF outputs being disposed along said axis.

9. A method of adjusting the coupling between an antenna array and a ferrite scanning line source which comprises the steps of:

(a) providing a ferrite scanning line source having a ferrite element having an RF input, a current source including a current transmission line extending through said ferrite element and a plurality of RF outputs spaced apart along said ferrite element, said ferrite element forming an RF transmission line and having a pair of metalized ferrite toroids spaced apart by a layer of dielectric material, said RF outputs disposed in said dielectric material and an input end portion, an output end portion and an axis therebetween, said RF outputs being disposed along said axis;

(b) providing an antenna element coupled to each of said RF outputs; and (c) adjusting at least one of the size and insertion depth of said RF outputs in said dielectric material to adjust the coupling between said antenna array and said source.

10. The method of claim 9 wherein said step of adjusting comprises the step of adjusting the size of said RF outputs.

11. The method of claim 9 wherein said step of adjusting comprises the step of adjusting the insertion depth of said RF outputs in said dielectric material.

* * * * *